United States Patent [19]

Rhodes

[11] Patent Number: 4,957,092

[45] Date of Patent: Sep. 18, 1990

[54] RING LAUNCHING METHOD AND APPARATUS

[76] Inventor: Richard O. Rhodes, 490 Belvedere St., San Francisco, Calif. 94117

[21] Appl. No.: 404,826

[22] Filed: Sep. 8, 1989

[51] Int. Cl.[5] ..... F41F 7/00

[52] U.S. Cl. ..... 124/20.1; 124/17; 124/42; 446/48

[58] Field of Search ..... 124/8, 21, 43, 42, 44, 124/37, 81, 17, 20 R; 446/46, 48

[56] References Cited

U.S. PATENT DOCUMENTS

| | | | |
|---|---|---|---|
| 1,164,609 | 12/1915 | Darton . | |
| 1,186,098 | 6/1916 | Horst . | |
| 1,700,880 | 2/1929 | Camp . | |
| 2,124,738 | 7/1935 | Johnson . | |
| 2,586,547 | 2/1952 | Marley . | |
| 2,953,378 | 6/1958 | LaVeigne . | |
| 3,176,988 | 4/1965 | DeFerdinardo . | |
| 3,207,144 | 9/1965 | Soderman | 124/21 |
| 3,232,285 | 2/1966 | Rasner . | |
| 3,264,776 | 8/1966 | Morrow . | |
| 3,363,899 | 1/1968 | Gross | 124/21 X |
| 3,430,620 | 3/1969 | Davis | 124/37 X |
| 3,517,656 | 6/1970 | Darrell | 124/42 X |
| 3,635,204 | 1/1972 | Plumb . | |
| 4,030,472 | 6/1977 | Watkins . | |
| 4,076,004 | 2/1978 | Huelskamp . | |
| 4,151,674 | 5/1979 | Klahn . | |
| 4,246,721 | 1/1981 | Bowers . | |
| 4,329,807 | 5/1982 | Atkinson . | |
| 4,390,148 | 6/1983 | Cudmore . | |
| 4,625,619 | 12/1986 | Ceniza | 124/42 X |
| 4,790,788 | 12/1988 | Hill . | |

*Primary Examiner*—Randolph A. Reese
*Assistant Examiner*—Jeffrey L. Thompson
*Attorney, Agent, or Firm*—Flehr, Hohbach, Test, Albritton & Herbert

[57] ABSTRACT

What is disclosed is a method and apparatus for launching a ring. The apparatus includes a frame with three frame limbs. Each frame limb includes a longitudinal axis, a neck, a shoulder, an arm and a port. The frame limbs are joined at a common axis along their longitudinal axes. An elastomeric band is connected to each arm and bridges each port. A trigger stretches the bands into their respective ports, this stretching action causes a concomitant rotational action associated with the bands. This rotational action will provide a rotational motion to the ring while the releasing of the trigger will provide an axial motion to the ring. This simultaneously imparted rotational and axial motion launches the ring from the frame for prolonged and stable flight.

25 Claims, 5 Drawing Sheets

RING LAUNCHING METHOD AND APPARATUS

BRIEF DESCRIPTION OF THE INVENTION

The present invention relates to a method and apparatus for launching a ring. More particularly, it relates to a method and apparatus for simultaneously imparting to a ring a forward movement along the axis of the ring and a rotational movement about the axis of the ring.

BACKGROUND OF THE INVENTION

A number of devices in the prior art are used for launching or shooting and catching rings. However, such prior art shooting devices for aerodynamic toys suffer from any of a number of deficiencies. For instance, many of the prior art devices have complicated designs. Complicated designs usually result in heavy devices. A structurally complicated device is also undesirable from the standpoint of ease of assembly and shipping. The aforementioned factors of excessive weight, complicated assembly and difficulty in shipping lend themselves to an expensive device.

Many prior art devices suffer from other shortcomings. For example, many prior art devices do not provide a mechanism to facilitate accurate aiming of the ring. Concomitantly, many prior art devices do not provide for the accurate flight of a launched ring.

Still other problems in prior art devices arise from the inconvenience of having to manually handle and load the ring. Yet another problem in prior art devices relates to the necessity of using a specially configured ring in conjunction with the apparatus.

OBJECTS AND SUMMARY OF THE INVENTION

Thus, it is an object of the present invention to provide an uncomplicated method and apparatus for launching a ring.

It is a related object of the present invention to provide a low weight apparatus.

It is another object of the present invention to provide an apparatus which can be easily assembled and disassembled for ease of shipping or storing.

It is yet another object of the present invention to provide a low cost apparatus.

A related object of the present invention is to provide an apparatus which eliminates the necessity of using a specially configured ring.

Another object of the present invention is to provide a mechanism for catching and loading a ring and thereby obviating manual handling of the ring.

Still another object of the present invention is to provide a mechanism which has aiming sights.

Yet another object of the present invention is to provide for straight and prolonged flight of a launched ring.

These and other objects are achieved by a novel method and apparatus for launching a ring. The apparatus includes a frame with a central longitudinal axis. The apparatus also includes a launching mechanism, supported on the frame, with elastic members. A ring centered on the longitudinal axis and positioned against the elastic members simultaneously receives from the elastic members both a rotational force and an axial force along the longitudinal axis. This force causes the ring to be launched from the frame and to advance in a forward direction with inertial stability provided by the rotational motion. The inertial stability allows for prolonged and stable flight of the ring in the forward direction. The method of the present invention includes the steps of engaging and disengaging the elastic members so as to simultaneously impart to a ring a rotational force and an axial force.

BRIEF DESCRIPTION OF THE DRAWINGS

Other objects and advantages of the invention will become apparent upon reading the following detailed description and upon reference to the drawings, in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
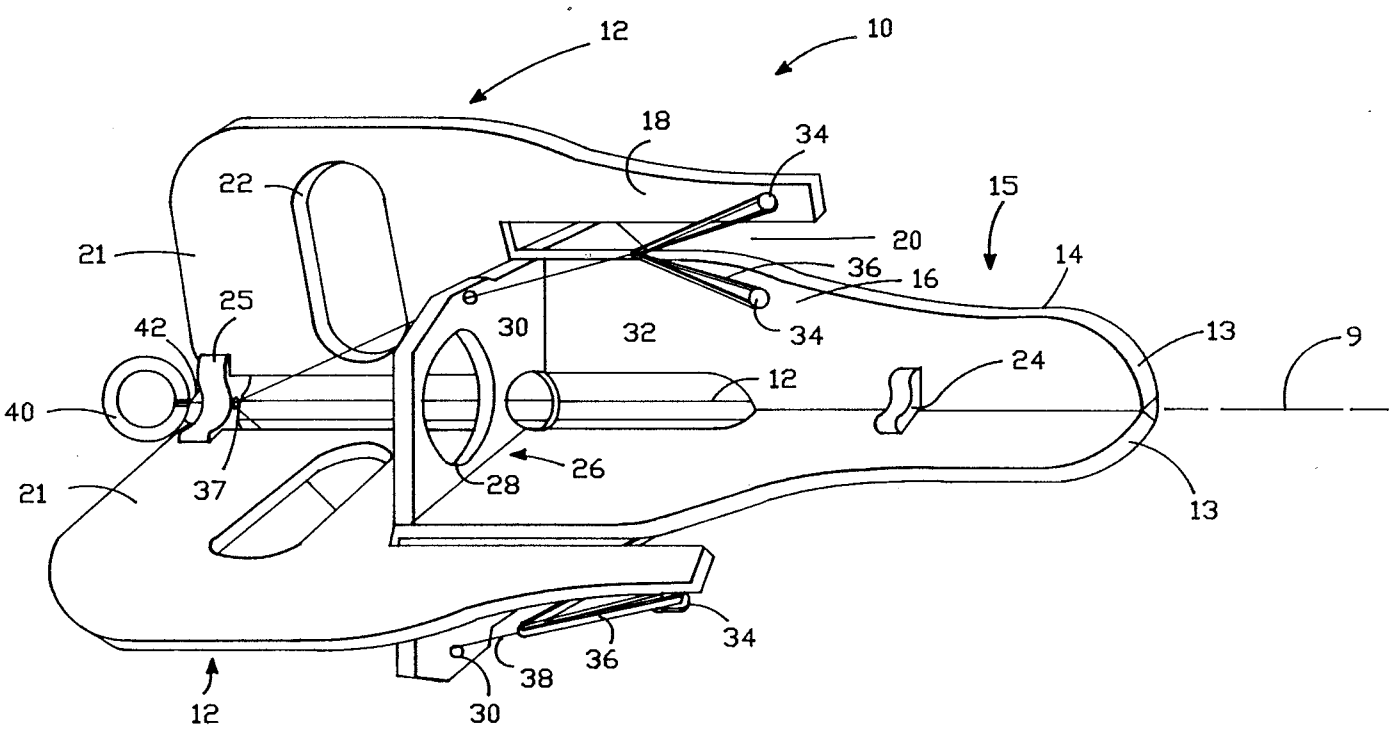
FIG. 1 is a perspective view of one embodiment of the ring launching apparatus of the present invention.

Turning now to the drawings, wherein like components are designated by like reference numerals in the various figures, attention is initially directed to FIG. 1. The figure depicts one embodiment of a ring launching apparatus 10 in accordance with the present invention.

To facilitate easy assembly and disassembly, the launching apparatus 10 preferably includes discreet frame limbs 12. The frame limbs may be formed from wood or in a preferred embodiment injection molded plastic.

Each frame limb is shaped to expedite launching of a ring. Thus, preferably, each frame limb 12 is a generally planar element and includes a tip 13. The tip 13 slopes into a neck 14 and then broadens into a shoulder 16. Opposite the shoulder 16 is an arm 18. Between the shoulder 16 and the arm 18 is an aperture defining a port 20. At the opposite end of each frame limb's tip 13 is a frame base 21. Preferably, each frame limb 12 includes an aperture defining a handle 22 between the frame base 21 and the port 20. The side of the frame limb 12 opposite the arm 18 and running from the tip 13 to the base 21 defines a longitudinal axis. Of course, other frame limb 12 designs may be successfully employed. In addition, while it is preferable from a manufacturing standpoint that each limb be identically shaped, identity of shape is not necessary.

Preferably, three frame limbs 12 are joined together along their respective longitudinal axes so as to define a central launching or shooting axis 9. The frame limbs 12 may be conveniently fitted together at approximately 120 degrees from each other by a notched support rib 24. Joined in this manner, the individual necks 14 of the individual frame limbs 12 form a neck region 15 which serves as a mechanism for alternatively aiming and catching an airborne ring concentric with launching axis 9. Catching such a ring is facilitated if an individual holds the apparatus 10 by using any handle 22.

Practically any type of ring may be employed in conjunction with the apparatus 10. However, preferably, the ring is thin and light weight and made of a polymeric material such as polyethylene or polypropylene by injection molding or by welding extruded material into a ring. Naturally, the ring must be of a circumference so as to fit into the individual ports 20 of the joined frame limbs 12. Other shapes, such as a cylinder, may be utilized in lieu of a ring.

After a ring is caught or otherwise placed onto the frame, the apparatus 10 may be held upright. In this position, gravity causes the ring to fall toward the individual shoulders 16 and ports 20. The ring's progress is stopped once it settles against the launching mechanism 32. Specifically, the launching mechanism 32 includes individual elastomeric bands 36 which are positioned between the individual arms 18 and shoulders 16 of the launching apparatus 10. The ring's position on the apparatus 10 is appreciated with reference to FIG. 3, which depicts a ring 11 seated against a plurality of individual elastomeric bands 36.

Returning to FIG. 1, the elastomeric bands 36 may be rubber bands, or any other suitably elastic material. Alternatively, one may employ springs. The individual elastomeric bands 36 are positioned between the individual arms 18 and shoulders 16. Pins 34 or other suitable fastening devices may be utilized to support the elastomeric bands 36.

The individual elastomeric bands 36 are connected to individual trigger lines 38. The trigger lines 38 are preferably formed of nylon cord. Alternatively, some other non-stretchable, inelastic, flexible material may be successfully employed. The individual trigger lines 38 proceed through individual guide holes 30 within guide plate 26. The guide plate 26 is preferably centered upon the longitudinal axis of the launching apparatus 10 and forms a notched connection to each of the frame limbs 12. The guide plate 26 preferably includes three sight holes 28 which facilitate aiming of the ring.

After proceeding through the individual guide holes 30, the individual trigger lines 38 preferably proceed through an aperture 37 in a second support rib 25 near the base of the apparatus 10. The trigger lines are preferably tied to a trigger 40, which in this embodiment is simply a ring. Preferably, between the trigger 40 and the second support rib 25 is a trigger cushion 42. In a preferred embodiment, the trigger 40 and trigger lines 38 are injection molded in one piece using nylon or other suitable polymeric materials.

The elastomeric bands 36 must move forward simultaneously if the ring is to be launched accurately. Preferably, the elastomeric bands 36 are identically configured so that there is equal force on each band 36 as it moves forward. The trigger 40 is preferably designed to enhance this feature. It should have sufficient mass to prevent any elastomeric band 36 from moving forward faster than any other.

Figure 2:
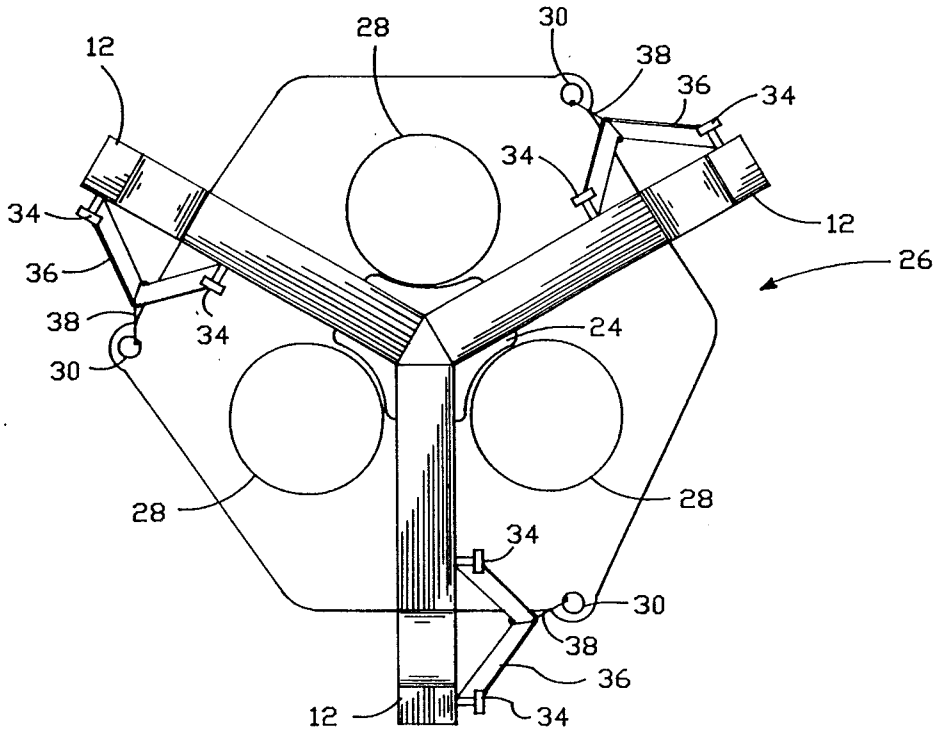
FIG. 2 is a front elevational view of the ring launching apparatus of FIG. 1.

An important feature of the present embodiment is the manner in which the individual trigger lines 38 engage the individual elastomeric bands 36, as best seen in FIG. 2. Note that because of the positioning of the individual guide holes 30 laterally offset from the individual planes defined by each of the frame limbs 12, the individual elastomeric bands 36 are pulled back or stretched by the trigger lines 38 at an angle to the plane defined by each of the frame limbs 12. This angular positioning imparts a rotational motion to the ring 11, as to be more fully described hereinafter.

Figure 3:
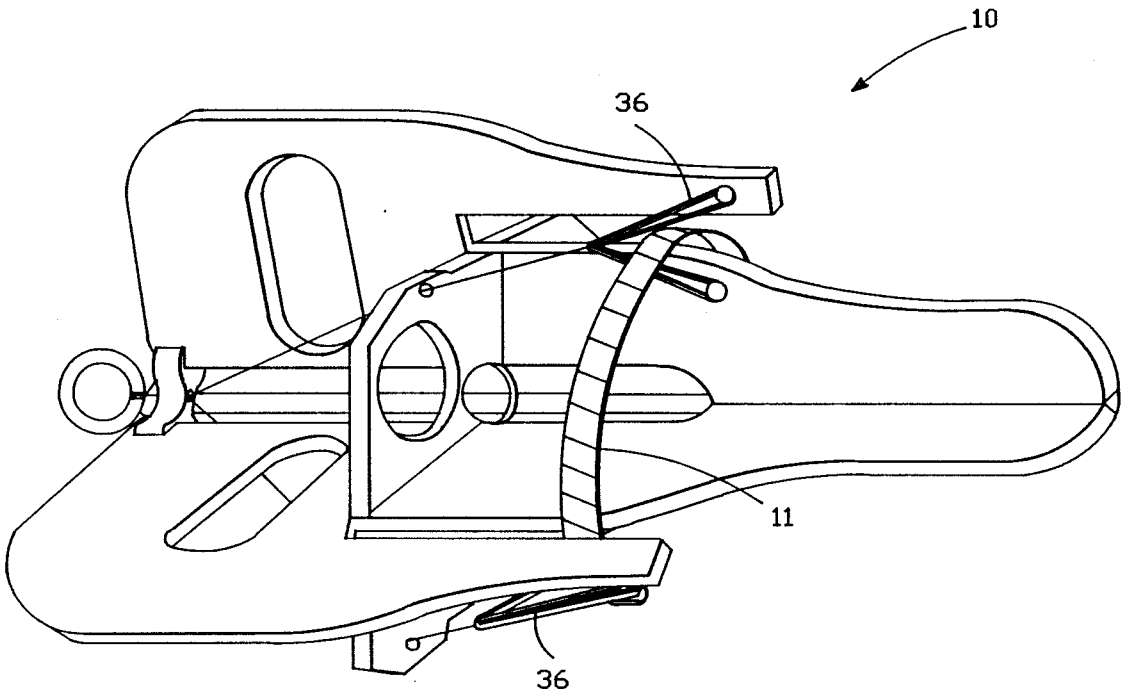
FIG. 3 depicts a common ring positioned upon the launching apparatus of FIG. 1.

Once a ring is positioned against the individual elastomeric bands 36, as previously depicted in FIG. 3, the trigger 40 can be pulled rearward. This will cause the individual trigger lines 38 to pull and stretch the individual elastomeric bands 36 backwards, into the individual ports 20 at an angle to the plane defined by each of the frame limbs 12 and therefore at an angle with launching axis 9. So long as the ring is positioned against the bands 36 and the launching axis is aimed at least slightly upward, the ring will move back with the bands by means of gravity. Once it does so, the launching axis can then be aimed horizontally or it can remain upward to any degree.

Once the trigger 40 is released, the backward pulling or stretching of the individual elastomeric bands 36 is terminated, causing the bands 36 and the ring seated against the bands 36 to snap forward, thereby launching the ring forward along the launching axis 9. Simultaneously, the bands 36 move at an angle toward the plane defined by each of the frame limbs 12. The limbs themselves confine the ring to a concentric position around the launching axis by preventing it from moving laterally. Thus, the angled movement of the bands imparts angular motion to the ring, causing it to rotate about its axis and the launching axis as it moves forward.

In sum, the ring simultaneously receives an angular or rotational motion and a motion in the forward direction. In other words, the ring simultaneously receives a forward, axial motion along the longitudinal axis of the apparatus 10 and a rotational motion about the longitudinal axis.

The rotational and axial forces cause the ring to continue to move forward and thereby be launched from the apparatus 10. Inertial stability is provided by the rotational motion. Consequently, the ring enjoys prolonged and stable flight concentric with launching axis 9.

In light of the foregoing, the method of using the present apparatus is now appreciable. The launching apparatus 10 may be held by any one of the handles 22. The apparatus 10 may then be used to catch a ring by using the neck region 15. After catching the ring, the apparatus 10 can be held upright, whereby gravity will cause the ring to rest against the individual elastomeric bands 36. The flight of the ring may be aimed by using the sight holes 28.

The flight of the ring may be accomplished by pulling the trigger 40 which is connected to the trigger lines 38. The trigger lines 38, by virtue of the positioning through the guide holes 30, move the elastomeric bands 36 both backward and at an angle from the plane defined by the frame limbs 12. The ring, positioned against the elastomeric bands 36 moves with the bands into the individual ports 20.

Releasing of the trigger causes the individual elastomeric bands 36 to snap forward along the longitudinal axis and to twist, or rotate toward the plane defined by each of the frame limbs. Consequently, this motion is imparted to the ring which is thereby launched from the apparatus 10.

It is apparent that the method and apparatus of the present invention can be used in a number of ways. For instance, a number of individuals may partake in a game of launching and catching a ring. Alternatively, the present invention can be used by a single individual to shoot a ring at a target. An individual may also use the present invention in the form of a "boomerang" by shooting the ring upright and catching it on its downward flight. Of course, many other uses are also possible.

Referring now to FIG. 2, the apparatus of FIG. 1 is seen from a front elevational view. The individual frame limbs 12 are easily discernable. It is appreciated in the figure that the limbs are held together by support rib 24. The guide plate 26 with sight holes 28 and guide holes 30 are easily discernible as well. The individual pins 34 supporting the individual elastomeric bands 36 are also apparent. The figure is particularly instructive insofar as it depicts how the trigger lines 38 hold the elastomeric bands at an angle to the plane defined by each of the frame limbs 12.

Figure 4:
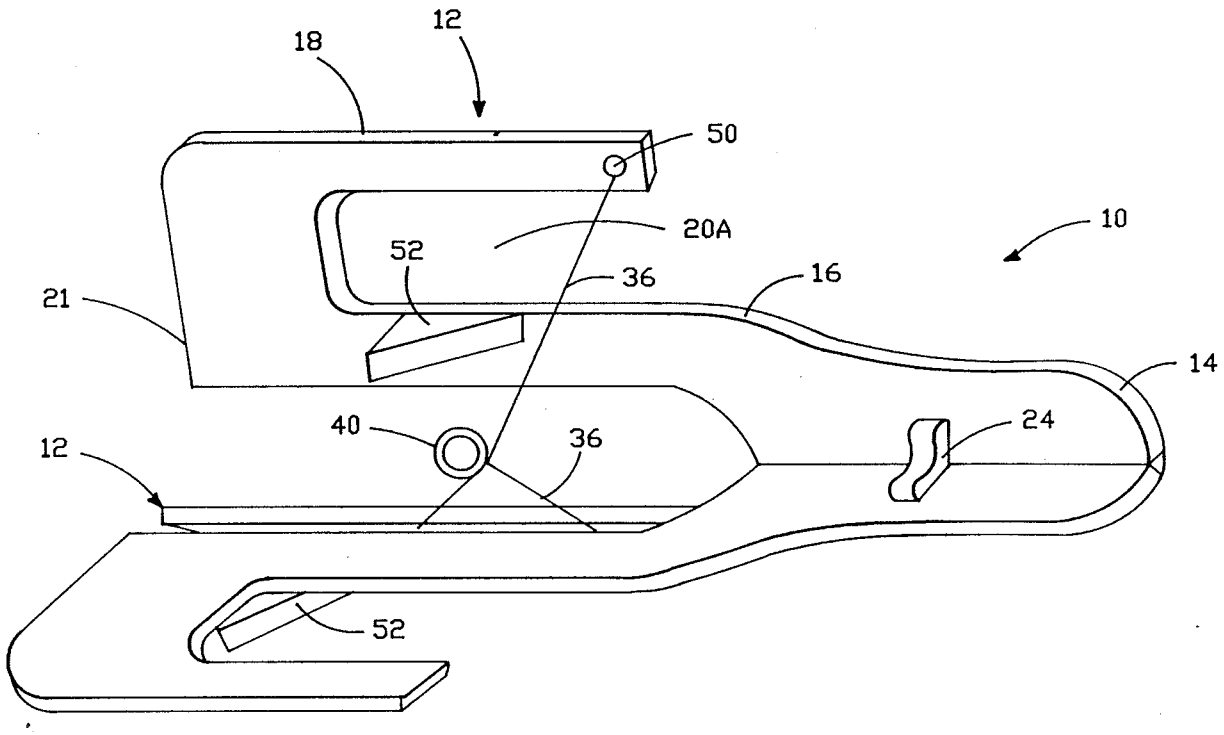
FIG. 4 is a perspective view of another embodiment of the ring launching apparatus of the present invention which includes a plurality of guide wedges.

An alternative embodiment of the present invention is revealed in FIG. 4. Unlike the embodiment of FIG. 1, in this embodiment there is not a guide plate, a second rib, or trigger lines. In addition, the ports 20A are wider than those in the embodiment of FIG. 1. Further, in lieu of a pin support on a shoulder, the elastomeric bands 36 are only connected to the individual arms 18 through individual arm apertures 50.

The embodiment of FIG. 4 includes an additional feature—a plurality of guide wedges 52. Each guide wedge 52, in the shape of a triangle or other suitable configuration, is positioned in the region between the port 20A and the longitudinal axis of each frame member 12 such that the three wedges are concentrically located around launching axis 9. Preferably, each guide wedge 42 is formed of a material with a low coefficient of friction, for example, polyethylene.

In the present embodiment, the trigger 40 is connected directly to the elastomeric members 36. When the elastomeric members 36 are supporting a ring in a manner as previously described and the trigger 40 is pulled, the individual elastomeric members 36 follow the angle of the individual guide wedges 52. Thus, they move rearward and laterally at an angle with the launching axis 9. When the trigger 40 is released, the individual elastomeric members 36 move in both a forward direction and along the angle created by the guide wedges. Thus, the ring is subject to both forward motion and angular motion, previously described. Consequently, as in the prior embodiment, the ring receives both axial and rotational motion and is thereby launched from the apparatus 10.

Figure 5:
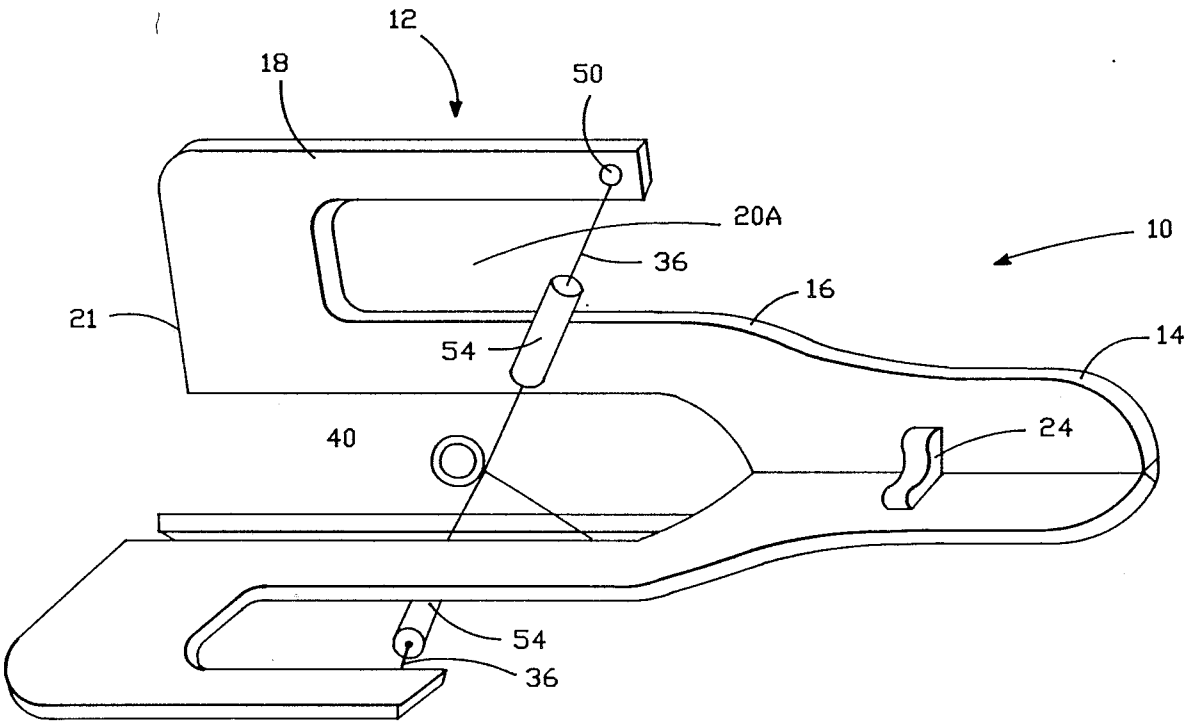
FIG. 5 is a perspective view of another embodiment of the ring launching apparatus of the present invention which includes a plurality of sleeves.

FIG. 5 reveals still another embodiment of the present invention, similar to the embodiment of FIG. 4. However, this embodiment does not include guide wedges, but rather a plurality of sleeves 54. Each sleeve 54 encases an elastomeric band 36 and is free to rotate around it. In an alternative design, each sleeve 54 may be solid and include a band extending from its top and bottom. In this design, the cylinder is free to rotate as the bands are free to twist. In either embodiment, the sleeves 54 are preferably formed from a material with a high coefficient of friction, for example polyurethane.

When the trigger is pulled, the sleeves move backward along the surface between the port 20 and the longitudinal axis which, as a friction region, causes the sleeves 54 to roll. When the trigger is released, in addition to the forward motion of the elastomeric bands 36, there is the rolling or unrolling motion of the sleeves. When viewed from above the apparatus 10, the cylinders roll in a counterclockwise direction which causes the ring to be launched with a rotational movement in the counter clockwise direction when viewed from the base of the apparatus. Thus, as in the prior embodiments, the ring receives both axial and rotational force and is thereby launched from the apparatus 10, in the manner heretofore described.

Thus, it is apparent that there has been provided, in accordance with the invention, a method and apparatus for launching a ring that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and scope of the appended claims.

What is claimed is:

1. An apparatus for launching a ring, comprising:

a frame defining a central longitudinal launching axis for supporting said ring such that said ring is positioned around the frame concentric with said longitudinal axis; and launching means supported on said frame for simultaneously imparting to said ring a rotational force and a forward, axial force along said longitudinal launching axis, whereby said imparted rotational and axial forces cause said ring to be launched from said frame and advance in a forward direction with inertial stability provided by said rotational motion thereby allowing prolonged and stable progression of said ring in said forward direction;

said launching means including elastic members movable between a relaxed position and a stretched position such that said ring rests against said elastic members when the latter is in said relaxed position and said stretched position, whereby movement of said elastic members from said stretched position to said relaxed position launches said ring.

2. An apparatus according to claim 1 wherein said elastic members move from said stretched position to said relaxed position in said forward direction at an acute angle to said longitudinal launching axis so as to simultaneously impart said axial and said rotational movement to said ring.

3. An apparatus according to claim 1 wherein said frame includes a guide wedge associated with and engaging against each of said elastic members and wherein the movement of each elastic member from its stretched position to its relaxed position in said forward direction is directed by said guide wedges which impart to that elastic member an angular motion at an acute angle with said launching axis, said angular motion being imparted to said ring to generate said rotational movement while said forward movement simultaneously imparts said axial motion.

4. An apparatus according to claim 1 wherein each of said elastic members includes a sleeve wherein movement of said elastic members from said stretched position to said relaxed position in said forward direction causes said sleeves to rotate about said elastic members and thereby impart rotary motion to said ring to generate said rotational movement while the forward movement of said elastic members simultaneously imparts said axial motion.

5. An apparatus for shooting a ring-shaped member forward along a straight-line path such that the plane of said member is normal to said path, said apparatus comprising:

(a) support means for supporting said ring-shaped member in a launching position concentric with said straight-line path; and (b) launching means movable relative to said support means for applying to said ring-shaped member an axial force in the forward direction along said straight-line path when said member is in its launching position and for simultaneously applying to said member at a plurality of discrete points about its periphery a rotational force about its own axis, whereby to cause said ring-shaped member to move forward along and concentric with said straight-line path while rotating about said path;

said launching means including stretchable band means movable between a relaxed position and stretched position such that the back end of said ring-shaped member rests against said band means when the latter is in its stretched position and said member is in its launching position, whereby movement of said band means back to its relaxed position launches said ring-shaped member.

6. An apparatus according to claim 5 wherein said band means moves from its stretched position to its relaxed position in the forward direction at an acute angle with said straight line path, whereby to impart both axial and rotational movement to said ring-shaped member.

7. An apparatus according to claim 5 wherein said support means includes guide wedge means engaging said band means and wherein the movement of said band means from said stretched position to said relaxed position in said forward direction is directed by said guide wedge means so as to impart an angular motion upon said band means, said angular motion being imparted to said ring to generate said rotational movement while the forward movement of said band means simultaneously imparts said axial motion.

8. An apparatus according to claim 5 wherein said stretchable band means includes sleeve means engaging said ring and wherein movement of said band means from said stretched position to said relaxed position in said forward direction rotates said sleeve means which imparts rotating action to said ring to generate said rotational movement while said forward movement of said band means simultaneously imparts said axial motion.

9. An apparatus for launching a ring, comprising:

a frame including a plurality of frame limbs with a common axis, wherein each of said frame limbs defines a generally planar element including a base, a side with a longitudinal axis, a relatively rounded end defining a tip, and a sloping side, the region from said tip, between said axial side and said sloping side defining a narrow neck growing broader from said tip toward said base so as to define a shoulder, from said shoulder, said sloping side progressing relatively parallel to said axial side, to a region medial of said shoulder and said base, said sloping side therefrom moving perpendicular to said axial side, and thereafter sloping toward said shoulder, relatively parallel to said axial side so as to define an arm, the region between said arm and said shoulder defining a port;

a plurality of elastomeric bands, each supported on each of said frame members between said shoulder and said arm; and a plurality of trigger lines, each of said elastomeric bands being connected to a trigger line, said trigger lines being attached to said elastomeric bands at an angle to the plane defined by each of said frame limbs, said trigger lines conjoining in a trigger, whereby engaging said trigger stretches said elastomeric bands into said ports, causing said ring centered on said common axis and seated against said elastomeric bands to recede into said ports, and releasing said trigger causes said elastomeric bands to simultaneously impart to said ring a forward, axial motion along said common axis and a rotational motion about said common axis, such that said ring is launched from said frame.

10. An apparatus according to claim 9 wherein each of said axial sides of each of said frame limbs are proximately positioned and aligned to form said common axis.

11. An apparatus according to claim 10 wherein said frame limbs are detachably connectable to at least one support rib substantially centered along said common axis.

12. An apparatus according to claim 11 wherein said frame comprises three frame limbs, each of said frame limbs positioned approximately 120 degrees from two other frame limbs.

13. The apparatus of claim 11 wherein each of said frame limbs includes an aperture between said base and said port, said aperture defining a handle.

14. The apparatus of claim 10 wherein said common axis defines means for catching said ring.

15. An apparatus for launching a ring, comprising:

a frame including a plurality of frame limbs with a common axis, wherein each of said frame limbs defines a generally planar element including a base, a side with a longitudinal axis, a relatively rounded end defining a tip, and a sloping side, the region from said tip, between said axial side and said sloping side defining a narrow neck, said narrow neck growing broader from said tip toward said base so as to define a shoulder, from said shoulder, said sloping side therefrom moving perpendicular to said axial side, and thereafter sloping toward said shoulder, relatively parallel to said axial side so as to define an arm, the region between said arm and said shoulder defining a port, the region between said port and said axial side including a guide wedge;

a plurality of elastic members, each of said elastic members being individually connected to each of said arms of each of said frame limbs, each of said elastic members converging therefrom and adjoined to other elastic members at a point substantially adjacent to said common axis of said frame, such that said ring is centered on said common axis and seated against said plurality of elastic members; and a trigger binding said elastic members, whereby pulling said trigger forces said elastic members against said guide wedges thereby creating an angular path for said elastic members whereupon releasing said trigger, said elastic members and said ring seated thereagainst move in a forward direction along said longitudinal axis, said twisting action imparting a rotational movement to said ring while said forward movement simultaneously imparts an axial motion to said ring.

16. An apparatus according to claim 15 wherein each of said axial sides of each of said frame limbs are proximately positioned and aligned to form said common axis.

17. The apparatus of claim 16 wherein said common axis defines means for catching said ring.

18. An apparatus according to claim 15 wherein said frame limbs are detachably connectable to at least one support rib substantially centered along said common axis.

19. An apparatus according to claim 15 wherein said frame comprises three frame limbs, each of said frame limbs positioned approximately 120 degrees from two other frame limbs.

20. An apparatus for launching a ring comprising;

a frame including a plurality of frame limbs with a common axis, wherein each of said frame limbs defines a generally planar element including a base, a side with a longitudinal axis, a relatively rounded end defining a tip, and a sloping side, the region from said tip, between said axial side and said sloping side defining a narrow neck, said narrow neck growing broader from said tip toward said base so as to define a shoulder, from said shoulder, said sloping side therefrom moving perpendicular to said axial side, and thereafter sloping toward said shoulder, relatively parallel to said axial side so as to define an arm, the region between said arm and said shoulder defining a port;

a plurality of elastic members, each of said elastic members being individually connected to each of said arms of each of said frame limbs, each of said elastic members converging therefrom and adjoined to other elastic members at a point substantially adjacent to said common axis of said frame, such that said ring is centered on said common axis and seated against said plurality of elastic members;

a plurality of sleeves, each of said sleeves encasing each of said elastic members between said arm and said axial point; and a trigger binding said elastic members, whereby pulling said trigger rotates said sleeves of each of said elastic members against the friction region between said port and said frame axis, whereupon releasing said trigger, said elastic members and said sleeves move in a forward direction along said longitudinal axis, said forward movement forcing said sleeves to rotate against said friction area, said rotational movement being imparted to said ring while said forward movement is simultaneously imparted as an axial motion to said ring.

21. An apparatus according to claim 20 wherein each of said axial sides of each of said frame limbs are proximately positioned and aligned to form said common axis.

22. An apparatus according to claim 20 wherein said frame limbs are detachably connectable to at least one support rib substantially centered along said common axis.

23. An apparatus according to claim 20 wherein said frame comprises three frame limbs, each of said frame limbs positioned approximately 120 degrees from two other frame limbs.

24. The apparatus of claim 20 wherein said common axis defines means for catching said ring.

25. A method of launching a ring from an apparatus comprising a frame defining a central longitudinal launching axis and a plurality of elastic members supported on said frame for holding said ring and for movement between a relaxed position and a stretched position, said method comprising the steps of:

positioning said ring against said elastic members;

stretching said elastic members from said relaxed position to said stretched position and causing it to move back to its relaxed position in a way which imparts to said ring both axial and rotational motion causing said ring to be launched from said frame and advance in a forward direction along said central longitudinal axis with inertial stability provided by said rotational motion thereby allowing prolonged and stable progression of said ring in said forward direction.

* * * * *